US012460327B2

(12) United States Patent
Erickson et al.

(10) Patent No.: US 12,460,327 B2
(45) **Date of Patent: *Nov. 4, 2025**

(54) KNIT FASTENER LOOP PRODUCTS

(71) Applicant: Velcro IP Holdings LLC, Manchester, NH (US)

(72) Inventors: Paul R. Erickson, New Boston, NH (US); Sihan Wang, Manchester, NH (US); Dale E. Turcotte, New Boston, NH (US); Okan Ala, Amherst, NH (US)

(73) Assignee: Velcro IP Holdings LLC, Manchester, NH (US)

( * ) Notice: Subject to any disclaimer, the term of this patent is extended or adjusted under 35 U.S.C. 154(b) by 94 days.

This patent is subject to a terminal disclaimer.

(21) Appl. No.: 18/235,905

(22) Filed: Aug. 21, 2023

(65) Prior Publication Data

US 2023/0392307 A1 Dec. 7, 2023

Related U.S. Application Data

(63) Continuation of application No. 15/718,115, filed on Sep. 28, 2017, now Pat. No. 11,767,619.

(51) Int. Cl.
*D04B 9/12* (2006.01)
*A44B 18/00* (2006.01)
(Continued)

(52) U.S. Cl.
CPC ..... *D04B 9/12* (2013.01); *A44B 18/0023* (2013.01); *A44B 18/0034* (2013.01); *D04B 1/04* (2013.01);
(Continued)

(58) Field of Classification Search
CPC . D04B 9/12; D04B 1/04; D04B 35/00; D04B 15/48; D04B 15/32; D04B 15/06;
(Continued)

(56) References Cited

U.S. PATENT DOCUMENTS 3,705,065 A 12/1972 Stumpf
3,822,162 A 7/1974 Stumpf
(Continued)

FOREIGN PATENT DOCUMENTS

CN 1069365 8/2001
CN 1338536 3/2002
(Continued)

OTHER PUBLICATIONS

Bruer, Shanna M., et al.; "Three-Dimensionally Knit Spacer Fabrics: A Review of Production Techniques and Applications;" Journal of Textile and Apparel, Technology and Management, vol. 4, Issue 4, Summer 2005; 31 pages.
(Continued)

*Primary Examiner* — Christopher W Raimund
(74) *Attorney, Agent, or Firm* — Fish & Richardson P.C.

(57) ABSTRACT

A method of making a loop fastener product features knitting, such as by circular knitting, a pile yarn and one or more ground yarns to form a stretchable knit fabric having loops of the pile yarn extending from a knit ground, with the ground yarns including polymers of differing melt temperatures. The knit fabric is then held in a desired state while the fabric is set by first applying sufficient heat to cause the lower melt temperature resin to flow into interstices of the fabric ground, and then allowing the fabric to cool. The cooled fabric ground is less stretchable in two orthogonal directions after setting than before setting, has a greater air permeability after setting than before setting, and has hook-engageable pile loops extending from bound interstices.

17 Claims, 8 Drawing Sheets

(51) Int. Cl.

| | |
|---|---|
| ***D04B 1/04*** | (2006.01) |
| ***D04B 9/26*** | (2006.01) |
| ***D04B 15/06*** | (2006.01) |
| ***D04B 15/32*** | (2006.01) |
| ***D04B 15/48*** | (2006.01) |
| ***D04B 35/00*** | (2006.01) |

(52) U.S. Cl.
CPC ..... *D04B 9/26* (2013.01); *D04B 15/06* (2013.01); *D04B 15/32* (2013.01); *D04B 15/48* (2013.01); *D04B 35/00* (2013.01); *D10B 2401/041* (2013.01); *D10B 2401/10* (2013.01); *D10B 2501/0632* (2013.01)

(58) Field of Classification Search
CPC ... D04B 9/26; A44B 18/0023; A44B 18/0034; D10B 2401/10; D10B 2401/041; D10B 2501/0632
See application file for complete search history.

(56) References Cited

U.S. PATENT DOCUMENTS

| | | | |
|---|---|---|---|
| 3,926,920 | A | 12/1975 | Georgoudis et al. |
| 4,080,928 | A | 3/1978 | Savard |
| 4,340,632 | A | 7/1982 | Wells et al. |
| 4,748,044 | A | 5/1988 | Fottinger et al. |
| 4,847,116 | A | 7/1989 | Duit |
| 4,910,062 | A | 3/1990 | Zinke et al. |
| 4,973,326 | A | 11/1990 | Wood et al. |
| 5,102,701 | A | 4/1992 | Davis et al. |
| 5,139,479 | A | 8/1992 | Peters |
| 5,227,227 | A | 7/1993 | Boulanger |
| 5,256,231 | A | 10/1993 | Gorman |
| 5,326,612 | A | 7/1994 | Goulait |
| 5,330,817 | A | 7/1994 | Arnott et al. |
| 5,547,531 | A | 8/1996 | Allen et al. |
| 5,554,239 | A | 9/1996 | Datta et al. |
| 5,614,281 | A | 3/1997 | Jackson et al. |
| 5,615,460 | A | 4/1997 | Weirich et al. |
| 5,654,067 | A | 8/1997 | Dinger et al. |
| 5,738,937 | A | 4/1998 | Baychar |
| 5,763,041 | A | 6/1998 | Leak et al. |
| 5,773,120 | A | 6/1998 | Deka et al. |
| 5,817,391 | A | 10/1998 | Rock et al. |
| 6,329,016 | B1 | 12/2001 | Shepard et al. |
| 6,342,285 | B1 | 1/2002 | Shepard et al. |
| 6,494,207 | B1 | 12/2002 | Kwok |
| 6,582,382 | B2 | 6/2003 | Domanski et al. |
| 6,681,457 | B2 | 1/2004 | Okawa et al. |
| 6,776,014 | B1 | 8/2004 | Laycock et al. |
| 6,869,659 | B2 | 3/2005 | Shepard et al. |
| 6,918,236 | B2 | 7/2005 | Springs |
| 6,929,617 | B2 | 8/2005 | McCormick et al. |
| 6,981,341 | B2 | 1/2006 | Baychar |
| 7,048,818 | B2 | 5/2006 | Krantz et al. |
| 7,132,144 | B2 | 11/2006 | Roberts |
| 7,156,937 | B2 | 1/2007 | Provost et al. |
| 7,282,251 | B2 | 10/2007 | Provost et al. |
| 7,303,808 | B2 | 12/2007 | Taneichi et al. |
| 7,373,699 | B2 | 5/2008 | Erickson et al. |
| 7,491,438 | B2 | 2/2009 | Demott et al. |
| 7,871,672 | B2 | 1/2011 | Crook et al. |
| 8,082,637 | B2 | 12/2011 | Tolan et al. |
| 8,535,776 | B2 | 9/2013 | Erickson |
| 9,206,545 | B2 | 12/2015 | Erickson et al. |
| 9,255,351 | B2 | 2/2016 | Menczywor |
| 9,763,497 | B2 | 9/2017 | Erickson et al. |
| 11,767,619 | B2 | 9/2023 | Erickson et al. |
| 2001/0003797 | A1 | 6/2001 | Guevara et al. |
| 2002/0045395 | A1 | 4/2002 | Lintecum et al. |
| 2002/0056502 | A1 | 5/2002 | Bordes |
| 2002/0136846 | A1 | 9/2002 | Prevost |
| 2003/0083413 | A1 | 5/2003 | Stumpauzer |
| 2004/0121694 | A1 | 6/2004 | Shepard et al. |
| 2004/0157036 | A1 | 8/2004 | Provost et al. |
| 2004/0167456 | A1 | 8/2004 | Kingsford et al. |
| 2005/0075028 | A1 | 4/2005 | Rock et al. |
| 2005/0196580 | A1 | 9/2005 | Provost et al. |
| 2005/0196583 | A1 | 9/2005 | Provost et al. |
| 2005/0208260 | A1 | 9/2005 | Baldauf |
| 2005/0233662 | A1 | 10/2005 | Kimbrell |
| 2007/0026181 | A1 | 2/2007 | Roberts |
| 2007/0270064 | A1 | 11/2007 | Aseere |
| 2008/0072629 | A1 | 3/2008 | Gehring |
| 2008/0082076 | A1 | 4/2008 | Kingsford |
| 2008/0289157 | A1 | 11/2008 | Higashinaka et al. |
| 2008/0305297 | A1 | 12/2008 | Barker et al. |
| 2009/0203280 | A9 | 8/2009 | Provost et al. |
| 2009/0217492 | A1 | 9/2009 | Gallant et al. |
| 2010/0247846 | A1 | 9/2010 | Erickson |
| 2012/0122365 | A1 | 5/2012 | Erickson |
| 2013/0255103 | A1 | 10/2013 | Dua et al. |
| 2019/0093264 | A1 | 3/2019 | Erickson et al. |

FOREIGN PATENT DOCUMENTS

| | | | |
|---|---|---|---|
| CN | 106510082 | | 3/2017 |
| CN | 206337366 | | 7/2017 |
| EP | 0330415 | | 8/1989 |
| EP | 342171 | | 11/1989 |
| EP | 223044 | | 1/1991 |
| EP | 604731 | | 7/1994 |
| EP | 1052319 | | 11/2000 |
| EP | 1444093 | | 8/2004 |
| EP | 1561441 | | 8/2005 |
| EP | 1638500 | | 3/2006 |
| EP | 2093317 | | 8/2009 |
| FR | 2801614 | | 6/2001 |
| JP | H05-115312 | * | 5/1993 |
| JP | H05115312 | A | 5/1993 |
| WO | WO1992016681 | | 10/1992 |
| WO | WO199410946 | | 5/1994 |
| WO | WO1999011452 | | 3/1999 |
| WO | WO2004077982 | | 1/2006 |
| WO | WO2006107844 | | 10/2006 |
| WO | WO 2015116293 | | 8/2015 |

OTHER PUBLICATIONS

CN Office Action in Chinese Appln. No. 201880062236.4, dated Feb. 22, 2021, 19 pages (with English Translation).
Free Dictionary, Definition of "stretch", https://www.thefreedictionary.corn/stretch, 2016. (Year: 2016).
Free Dictionary, Definition of "tentering", https://www.thefreedictionary.corn/tentering, 2014. (Year: 2014).
Maliwatt "Stitch-Bonding Machines for Nonwoven-Processing" Brochure by Karl Mayer, published 2007 (8 pages).
PCT International Search Report and Written Opinion in International Application No. PCT/EP2018/075717, dated Jan. 24, 2019, 16 pages.
PCT Written Opinion of the International Preliminary Examining Authority in International Application No. PCT/EP2018/075717, dated Aug. 23, 2019, 10 pages.
Poly(butylene terephthalate) Properties, PolymerProcessing.com (2011) (Year: 2001).

* cited by examiner

KNIT FASTENER LOOP PRODUCTS

CROSS REFERENCE TO RELATED APPLICATIONS

This application is a continuation of U.S. Ser. No. 15/718,115, filed Sep. 28, 2017, May 1, 2020, and is hereby incorporated by reference in its entirety for all purposes.

TECHNICAL FIELD

This invention relates to methods of making loop fastener products, particularly circular knit loop fabrics, and the products made by such methods.

BACKGROUND

Some knit materials are formed as circular knit materials, meaning that they are initially knit as a tube on a machine in which the knitting needles are organized into a circular knitting bed. The needles are sequentially activated about the circular bed, such as by a cam surface acting against butt ends of the rotating set of needles, to lift and accept a yarn fed from a spool into a yarn carrier plate, to form a spiral row of stitches about the end of the tube. Such a process is also referred to as circular weft knitting. Circular-knit fabrics are known to generally be rather stretchable as knitted, and are often stabilized with coatings or other binders. Warp-knit fabrics typically have less longitudinal stretch than circular knits, and are often stabilized with binders.

Reducing stretch and improving fabric stability are desirable with hook and loop fasteners, as are reductions in the cost of such fasteners.

SUMMARY

One aspect of the invention features a method of making a loop fastener product, by a process involving knitting a pile yarn and one or more ground yarns to form a stretchable knit fabric having loops of the pile yarn extending from a knit ground. At least one of the ground yarns is a bicomponent yarn with a filament comprising a first portion of a first polymer and a second portion of a second polymer, the first and second portions bonded together along a length of the filament and defining a boundary between the first and second polymers. While the fabric is subsequently held in a flat state, it is set by first applying sufficient heat to cause resin of the sheath of the bicomponent yarn filament to flow into interstices of the fabric ground, and then allowing the fabric to cool, such that the cooled fabric ground is less stretchable in two orthogonal directions after setting than before setting. The cooled fabric has a greater air permeability after setting than before setting, and has hook-engageable pile loops extending from interstices bound by the first polymer.

In some cases, knitting the pile yarn and one or more ground yarns involves circular knitting, producing a circular-knit fabric.

The first portion of the filament of the bicomponent yarn may form a sheath about a filament core of the second polymer, or be of a different bicomponent structure. The first and second portions of the filament of the bicomponent yarn are preferably both longitudinally continuous.

The bicomponent yarn can be a yarn of multiple bicomponent filaments.

In some examples, the bicomponent yarn is a first yarn of the one or more ground yarns, the one or more ground yarns also including a second yarn of a third polymer. The third polymer may be of a lower melting point than the second polymer. For example, the second polymer may be a polyester and the third polymer a nylon. In some cases, the knitting includes feeding the first and second yarns together through a common hole to a needle rack of a circular knitting machine.

The third polymer may be advantageously more susceptible to radio-frequency energy absorption than the second polymer.

In some cases, the method also includes texturizing the first and second yarns together prior to knitting.

In some embodiments, the pile yarn is a multi-filament yarn, and/or texturized yarn. Preferably, the pile yarn is or includes an extruded monofilament having a tenacity of at least 4 grams per denier.

The fabric may be held in a flat state on a tenter frame, for example.

In some cases, the heat is applied only in selected areas of the fabric, thereby causing a variation in setting across the fabric. For example, the heat may be applied by controlled jets of hot air, such as discontinuous jets. Alternatively, the heat may be applied by an embossed heater roll having a patterned surface over which the fabric is trained, such that the pattern of the surface determines a pattern of the selected areas. The variation in setting may advantageously cause the fabric to pucker out of its plane.

The cooled fabric preferably has an air permeability, through the fabric as tested according to ASTM D737, of at least 325 CFM. The cooled fabric preferably has an in-plane stiffness, as tested according to ASTM D1388 in each of two orthogonal directions, of at least 4 mm.

In some cases, the pile yarn is of a different color than the bicomponent yarn, and setting the fabric changes a perceptible color of a side of the fabric opposite the pile loops.

Heat setting the fabric preferably involves subjecting the fabric to an environmental temperature greater than a softening temperature of the first polymer. The heat setting may cause resin of the sheath of the bicomponent yarn filament to also flow into a pile of the fabric, such as into a base of the pile, while leaving the pile hook-engageable.

Another aspect of the invention features a method of making a loop fastener product, including circular knitting a pile yarn and one or more ground yarns to form a stretchable circular-knit fabric having loops of the pile yarn extending from a knit ground, holding the circular-knit fabric in a desired state, and while the fabric is held, setting the fabric. At least one of the ground yarns is a yarn with a filament containing a first polymer and a filament containing a second polymer. The fabric is set by first applying sufficient heat to cause resin of the first polymer to flow into interstices of the fabric ground without melting the second polymer, and then allowing the fabric to cool, such that: the cooled fabric ground is less stretchable in two orthogonal directions after setting than before setting, the cooled fabric has a greater air permeability after setting than before setting, and the cooled fabric has hook-engageable pile loops extending from interstices bound by the first polymer.

In some examples, the desired state is planar and taut, and the fabric may be held, for example, on a tenter frame.

In some cases, at least one of the ground yarns is a first yarn with a bicomponent filament in which the first polymer forms a sheath about a filament core of the second polymer. The ground yarn may have multiple bicomponent filaments. The ground yarns may also include a second yarn of a third polymer, such as a polymer of a lower melting point than the second polymer. For example, the second polymer may be a polyester and the third polymer a nylon. The method may include feeding the first and second yarns together through a common hole to a needle rack of a circular knitting machine. The third polymer may be more susceptible to radio-frequency energy absorption than the second polymer.

In some cases, the method includes texturizing the first and second ground yarns together prior to knitting.

In some embodiments, the pile yarn is a multi-filament yarn, and/or texturized yarn. Preferably, the pile yarn is or includes an extruded monofilament having a tenacity of at least 4 grams per denier.

The fabric may be held in a flat state on a tenter frame, for example.

In some cases, the heat is applied only in selected areas of the fabric, thereby causing a variation in setting across the fabric. For example, he heat may be applied by controlled jets of hot air, such as discontinuous jets. Alternatively, the heat may be applied by an embossed heater roll having a patterned surface over which the fabric is trained, such that the pattern of the surface determines a pattern of the selected areas. The variation in setting may advantageously cause the fabric to pucker out of its plane.

The cooled fabric preferably has an air permeability, through the fabric as tested according to ASTM D737, of at least 325 CFM. The cooled fabric preferably has an in-plane stiffness, as tested according to ASTM D1388 in each of two orthogonal directions, of at least 4 mm.

In some cases, the pile yarn is of a different color than the bicomponent yarn, and setting the fabric changes a perceptible color of a side of the fabric opposite the pile loops.

Heat setting the fabric preferably involves subjecting the fabric to an environmental temperature greater than a softening temperature of the first polymer. The heat setting may cause resin of the sheath of the bicomponent yarn filament to also flow into a pile of the fabric, such as into a base of the pile, while leaving the pile hook-engageable.

Other aspects of the invention include new loop fastener products made by the above methods.

The invention can produce a functional fastener loop product relatively quickly and at low cost, for the most part using readily available equipment. The invention can also provide good RF welding characteristics in the final product, and in the case of circular knits can produce a product with good dimensional stability without the need of subsequent binder coating, resulting in good permeability.

The details of one or more embodiments of the invention are set forth in the accompa-nying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
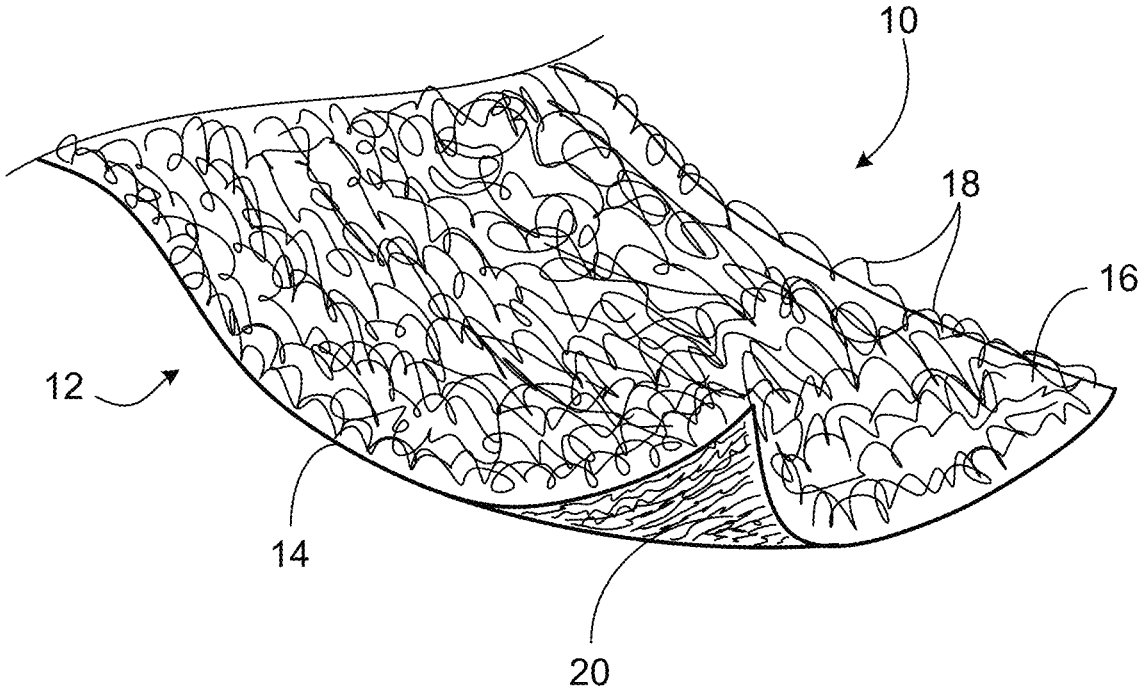
FIG. 1 is a perspective view of a circular-knit loop fastener product.

Referring first to FIG. 1, loop fastener product 10 is in the form of a circular-knit fabric 12 having a knit ground 14 and having a fastening face 16 from which engageable loops 18 extend as a pile, and a back face 20. In knitting terms, back face 20 is the technical face of the knit fabric.

Figure 2:
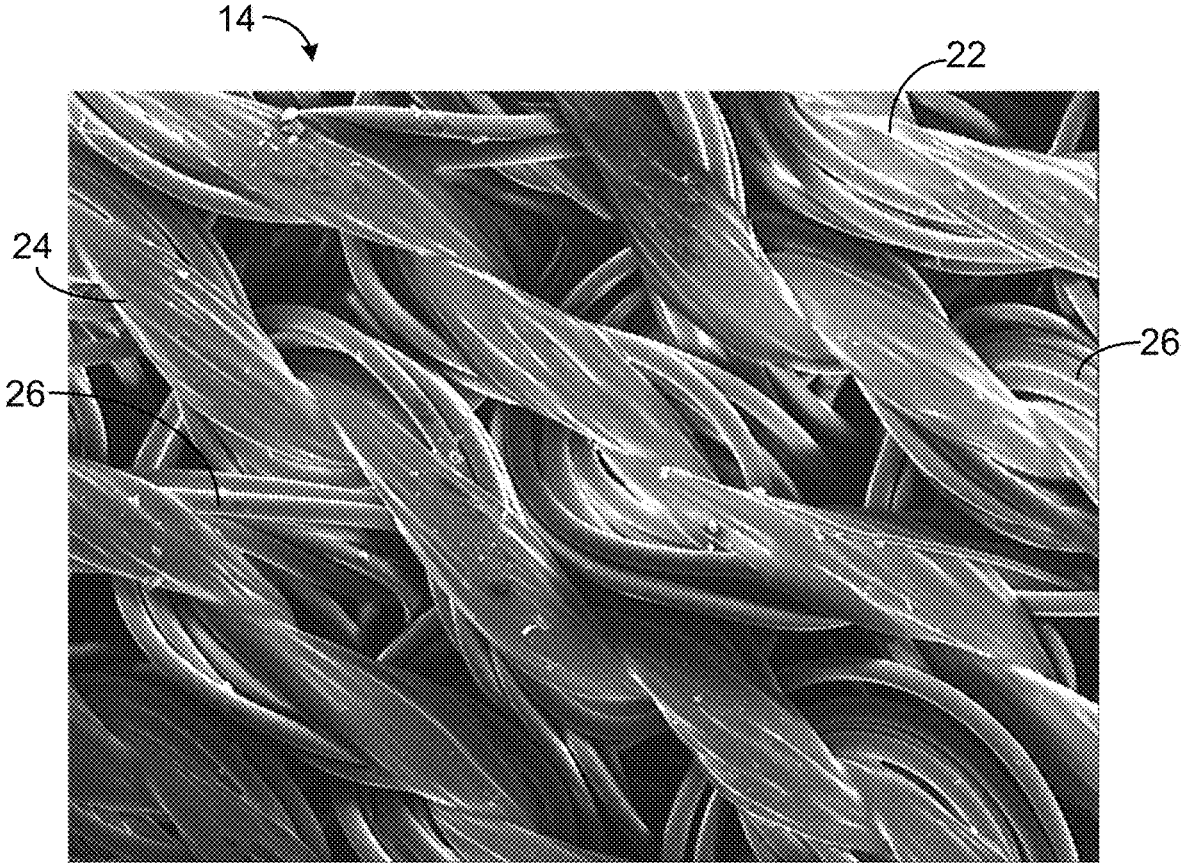
FIG. 2 is a magnified photograph of a back face of a first example of the product.

Referring also to FIG. 2, ground 14 includes bicomponent ground yarns 22 including multiple bicomponent filaments 24, and may contain other ground yarns. Also shown in this view are sections of pile yarn 26 exposed on the technical face of the product. The bicomponent filaments are comprised of two distinct polymers, one of a lower melting temperature than the other. In this image, some of the lower melting polymer of the bicomponent ground yarns 22 has melted, flowed into interstices between other filaments, and then solidified to bond the yarns of the ground together and dimensionally stabilize the product. This tends to make the fabric of a stiffer hand and of lower elasticity than would normally be used as a clothing fabric, for example, as the ground fibers are bound to limit relative motion of adjacent fibers. This can provide a stiffness similar to that of a binder-coated warp knit, for example, and is particularly suitable for fastening applications in which the machine-direction stretchability of the fabric may be detrimental to performance and disadvantageously deform under tensile load. By fusing the ground internally, the resulting knit fabric can be more stable against shrinkage and stretching, even through repeated washings, than a coated product, while also maintaining a desirable amount of air permeability. As will be noted below, the breathability of the product can actually increase on fusing.

The bicomponent ground yarns may be of a polyester, for example, with both a relatively high melt polyester portion and a relatively low melt polyester portion. These yarns are typically multifilament yarns of varying yarn denier and filament counts, and selected to develop a specific fabric weight or stability. A secondary multifilament ground yarn may be a Nylon or a polyolefin yarn, for example, added to increase RF weldability. In some cases, the secondary multifilament ground yarns are of a resin with a lower melting temperature than either portion of the bicomponent ground yarns. The pile yarn is preferably an extruded multifilament having a tenacity of at least about 4 grams per denier, but could for some applications have a tenacity as low as 1 or as high as 10 grams per denier. Each filament in the multifilament yarn may have a denier less than 1.0 or as high as 30. Increasing the denier per filament can increase the cycle life of the fastener.

In one example, a 100% PET polyester bicomponent fiber, supplied by Hyosung Corporation, was co-extruded as a sheath-core yarn (as in FIG. 3A) and each monofilament fiber was approximately 2.0 to 2.9 denier. The core of the fiber was approximately 70 percent of the total cross section, with the low melt sheath forming the remaining 30 percent. Multiple monofilaments were extruded through a spinneret to create a multifilament yarn such as a 50-denier yarn with 24 filaments (50/24), a 70-denier yarn with 24 filaments (70/24) and a 140-denier yarn with 48 filaments (140/48). The core of each monofilament had a melting temperature of approximately 245 to 250 C, but the sheath would start to soften at approximately 130 to 140 C. We found that a temperature of at least 230 C would cause the sheath to melt and sufficiently flow to bind the fabric. By varying the oven temperatures, the bonding and stiffness can be modified. These bicomponent filaments exhibit a tenacity of 4.5 to 5.1 grams per denier, an elongation of about 37 to 38%, a shrinkage of 6.6 to 7.0%, and have a bright Luster. Depending on the weight and performance needed, lower denier yarns may be employed to produce lighter fabrics, and higher denier yarns for heavier fabrics.

In one example, a lightweight circular knit jersey fabric was knit on a 28-gauge machine with 140/48 natural color bicomponent polyester yarn in the ground, and a 200-denier, 10 filament (200/10) flat untexturized yarn for the pile. Both natural and pre-dyed yarns were used for the pile surface. The fabrics were knit with a 1.0 mm sinker to make a low pile loop, although sinker heights as high as 3.8 mm or higher may be employed. The number of stitches per inch was varied to produce the desired fabric weight, with examples run at 42, 33, 28, and 25 stitches/inch. One example was knit at 25 stitches/inch, using a 140/48 polyester bicomponent yarn and a 200/10 pile yarn. This combination resulted in a large amount of meltable fiber on the technical face and a high cyclability. Examples were finished differently depending on whether they were natural or dope-dyed. Dope-dyed fabrics can be napped directly after knitting. Low cost natural white fabrics can also be napped after knitting. The fabric may be dyed in jet dyeing equipment, then napped. Prior to napping the 25 stitch-per-inch fabric, the greige fabric width was approximately 200 mm wide, and the fabric width after napping was approximately 190 mm. Napper wire size and napping settings were selected to maintain an unbroken loop.

Figure 3A:
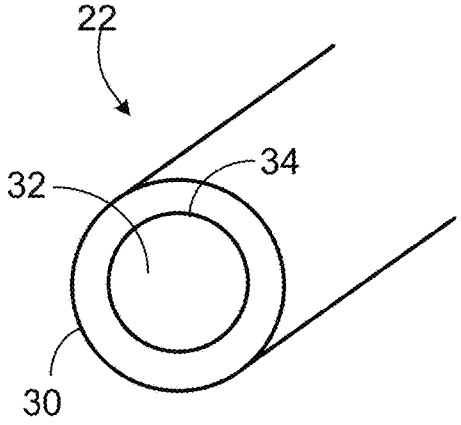
FIGS. 3A and 3B illustrate two bicomponent yarn structures.
Figure 3B:
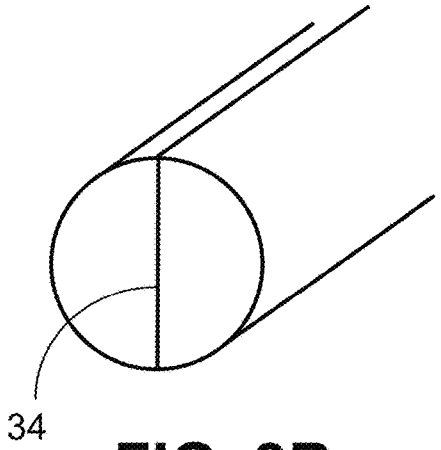

In the example of FIG. 2, the bicomponent filaments of ground yarns 22 are of the sheath/core type, in which the lower melt temperature polymer forms a sheath 30 about a core 32 the higher melt temperature polymer, as shown schematically in FIG. 3A. As an alternative, the lower melting and higher melting portions of the bicomponent filament may be coextruded side-by-side, such that each forms part of the exposed filament surface, as shown in FIG. 3B. Other configurations are also possible. Preferably, the lower melt temperature and higher melt temperature polymers are distinct and unmixed, bonded together along a length of the filament and defining a boundary 34 between the two polymers.

Figure 4:
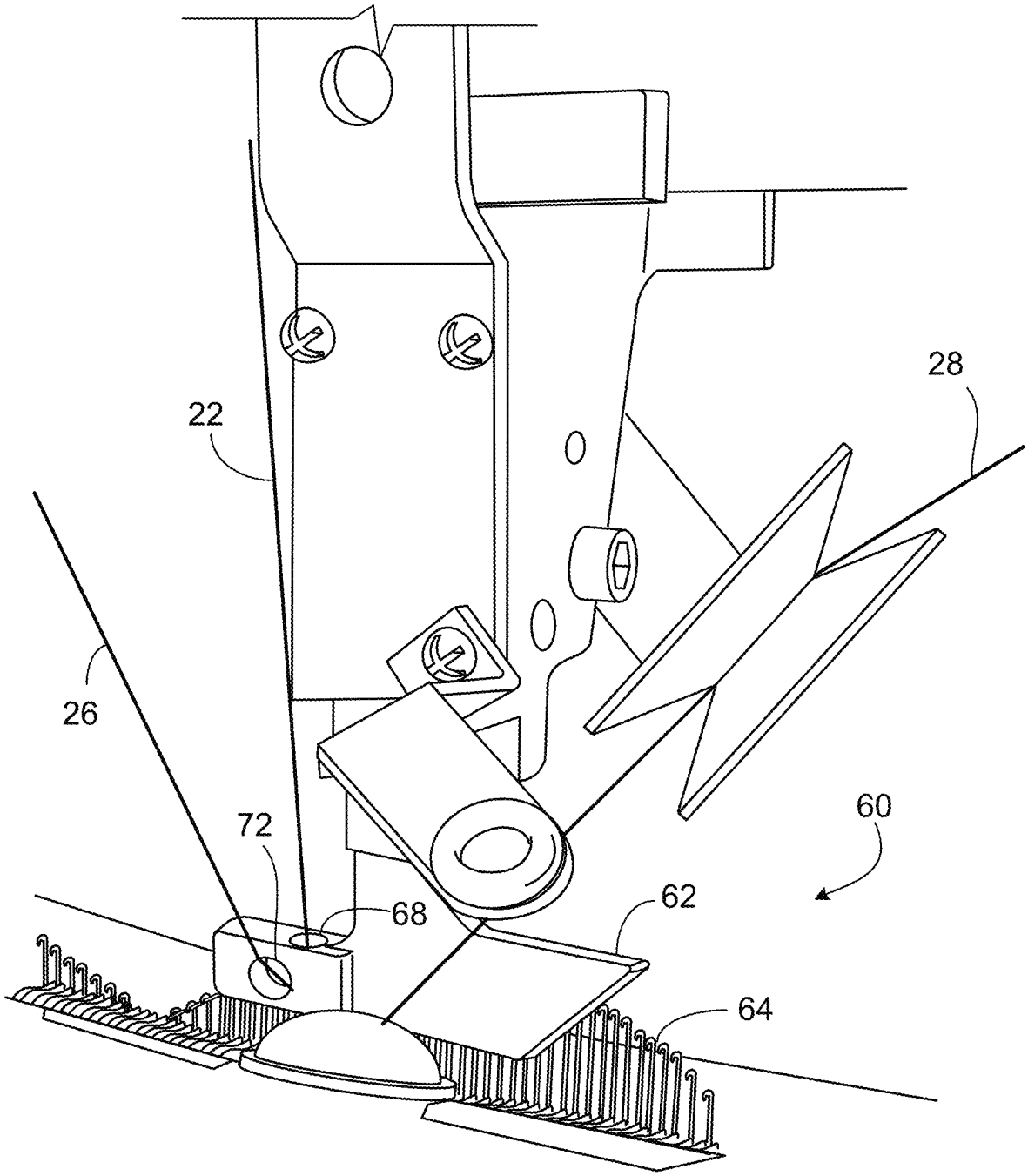
FIG. 4 illustrates a circular knitting process using three yarns.

Referring next to FIG. 4, the ground and pile are knit in a single stage knitting process on a standard circular knitting machine equipped to feed the three distinct yarns from different spools. This figure shows just one of a series of similar yarn carrier assemblies spaced about the rim of a circular knitting machine on which the fabric is formed. The carrier assembly 60 carries a yarn carrier plate 62 that receives the three yarns from their respective spools (not shown) via positive yarn storage feeders, and directs them sequentially to a series of needles 64 that are raised by a cam system with respect to the carrier plate. The ground yarns (bi-component ground yarn 22 and any secondary ground yarn 28) are separately fed to the carrier plate. Pile yarn 26 is fed into a pile yarn feed hole 72 in the side surface of the carrier plate. While the two ground yarns emerge together from a ground feed hole at the bottom of the foot of the carrier plate, the pile yarn 26 passes out the back side of the carrier plate and is knit into the material over a series of sinkers (not shown) to form the pile. As an alternative, the two ground yarns may be joined and fed together to a single ground yarn feed hole, such as hole 68.

Figure 5:
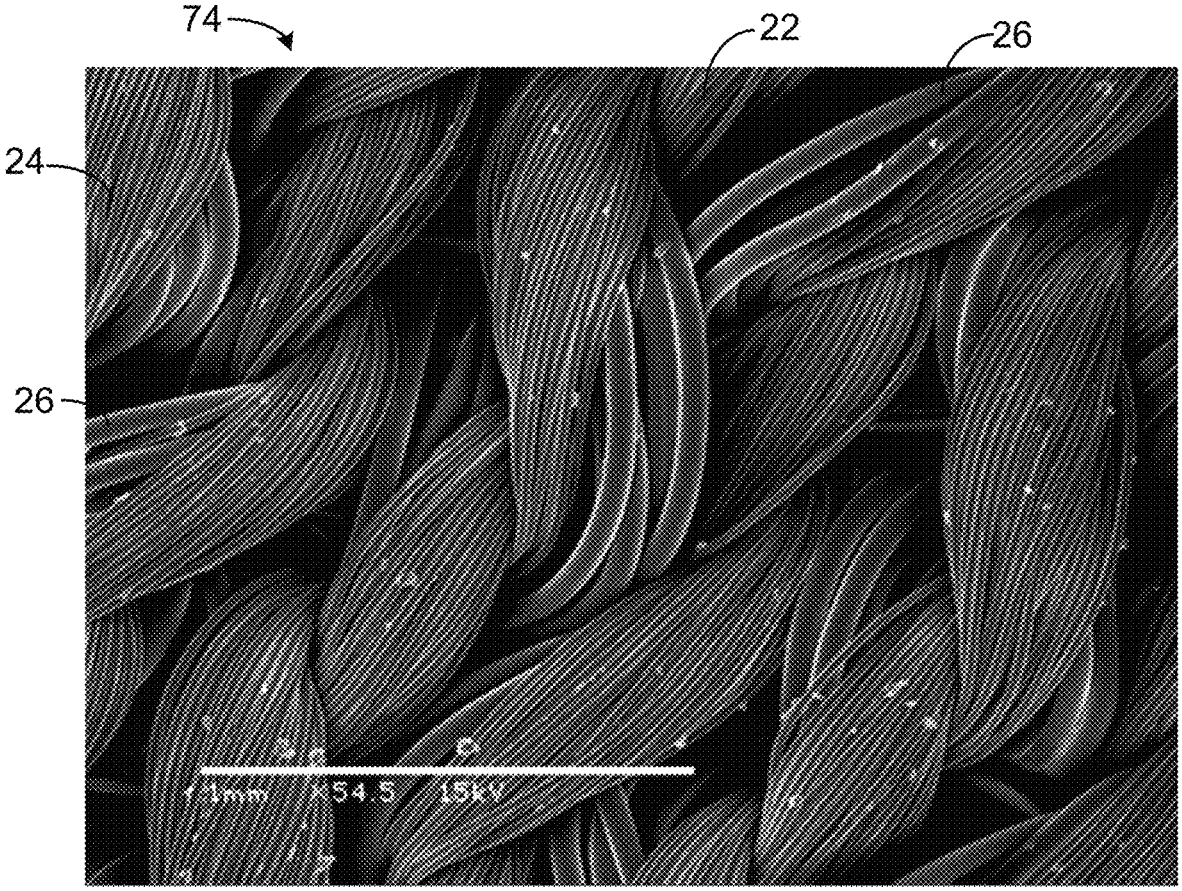
FIG. 5 is a magnified photograph of the back face of the example of FIG. 2, prior to heat setting.

As the fabric comes out of the knitting machine, it is relatively stretchable in the machine direction, similar to a typical circular-knit fabric. Following knitting, the fabric tube may be slit longitudinally, washed, napped and spooled for later processing. Using texturized pile fibers may help to avoid any need to nap the pile, either before or after spooling. As shown in FIG. 5, the circular-knit fabric 74 prior to setting has a ground in which none of the yarns are fused and the structure is held together merely by the interlocking of stitches. The bicomponent filaments of ground yarn 22, in particular, are unmelted and have distinct surfaces.

Figure 6:
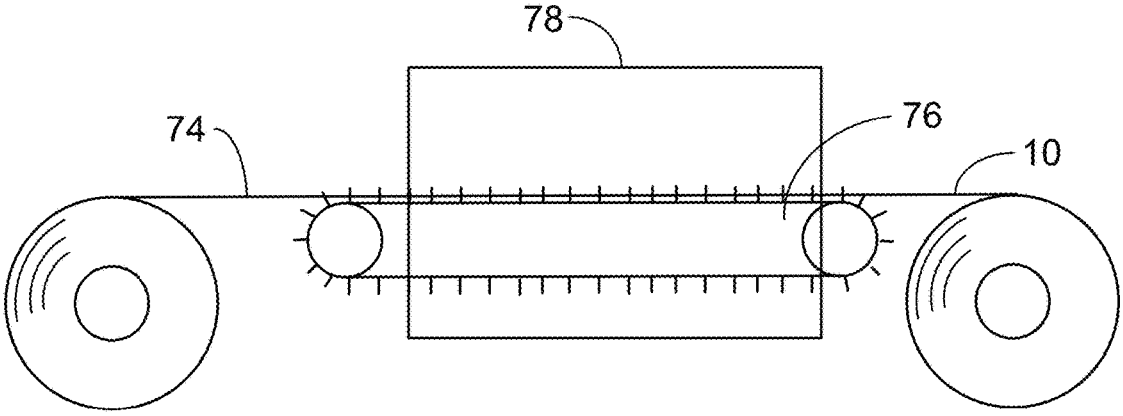
FIG. 6 illustrates a heat setting process.

Referring next to FIG. 6, after washing and napping the knit fabric 74 is later pinned to a moving tenter frame chain 76, on which it is held flat and under a relatively constant widthwise tension as it passes through a heater 78. The temperature within the heater, and the speed of the process, are selected to apply sufficient heat to cause resin of the low melt temperature polymer of the bicomponent yarn filaments to flow into interstices of the fabric ground. In some cases, the resin of the low melt temperature polymer also flows into the base of the fabric pile, but not enough to render the pile unengageable by fastener hooks. The fabric is then allowed to cool (whether by forced cooling or simply exposure to an environment at a temperature lower than the cooling fabric), completing setting. Once set, the cooled fabric ground is less stretchable in two orthogonal directions (machine direction and transverse direction) after setting than before setting, the cooled fabric has a greater air permeability after setting than before setting, and has hook-engageable pile loops extending from interstices bound by the low melt temperature polymer.

Throughout heating, the fabric is held flat and under light transverse tension, typically just enough tension to keep the fabric on the tenter frame pins but not enough to actively stretch the fabric. In this example, using a low melt temperature polymer with a softening temperature of 375 degrees Fahrenheit, heater 78 was maintained at 390 degrees Fahrenheit during setting, and the fabric remained in the heater for a heating time of 60 seconds. For the dryer used, this equated to a speed of about 18 meters/min. In some cases, the ground of this fabric may grow slightly in width during treatment, such that the overall width increases even under very light tension. As the fabric grows, the tenter frame width adjusts to maintain the slight transverse tension on the fabric, to continue to hold the fabric in a flat state. The fabric can also be stretched a modest amount (e.g., 13 percent in width) and will still perform as a fastener product, but with slightly lower performance.

After setting, the finished fabric is a longitudinally continuous loop fastener product 10 that can be spooled, slit, cut or otherwise finished.

Figure 6A:
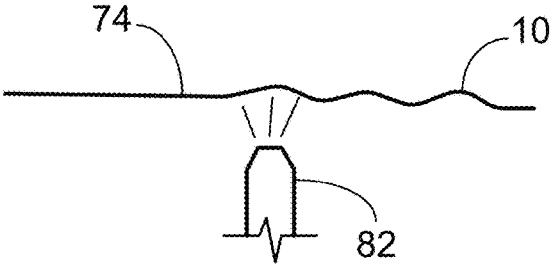
FIGS. 6A and 6B illustrate alternate heat setting processes.
Figure 6B:
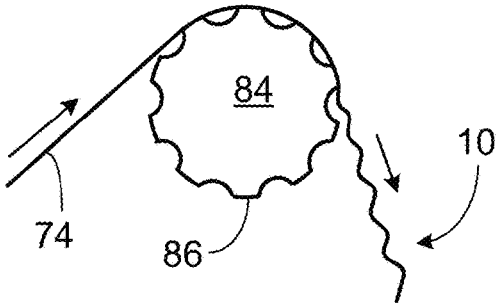

Rather than being heated uniformly in an oven, the fabric may be heated only in selected areas, causing a variation in setting across the fabric that can result in a puckering of the fabric out of its plane. This can further aid in 'bulking' the fabric, and/or can provide a desired texture or pattern. The heat may applied, for example, by controlled jets 82 of hot air (as in FIG. 6A), or by an embossed heater roll 84 having a patterned surface 86 over which the fabric is trained (as in FIG. 6B).

Figure 7:
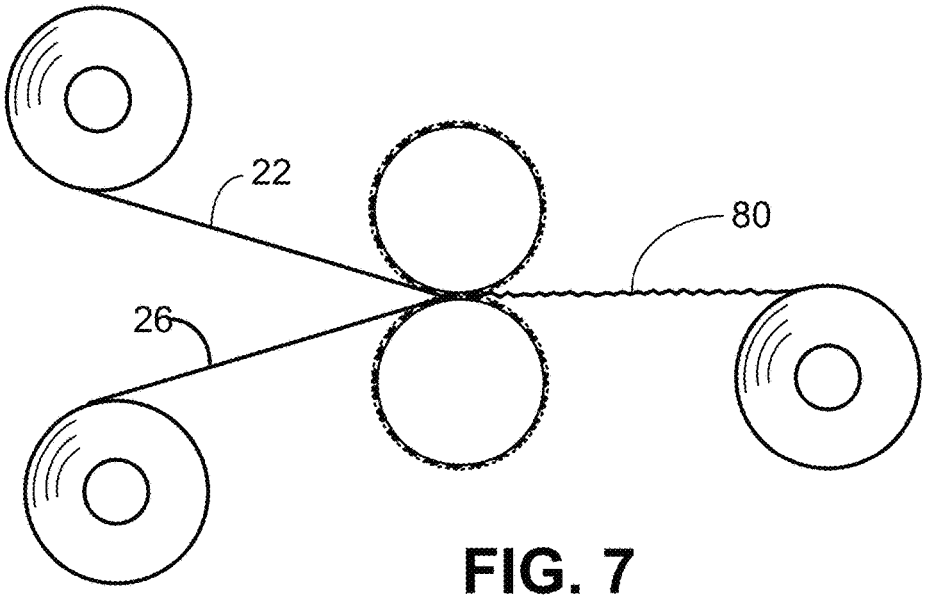
FIG. 7 illustrates texturizing two separate yarns together to form a single combined yarn.

Referring next to FIG. 7, in some cases bicomponent ground yarn 22 and a secondary ground yarn 26 are texturized together to form a single combined yarn 80 that can be fed into a single feed hole of the yarn carrier plate of the knitting machine. In some cases, a low melt single yarn and a high melt single yarn can be texturized, twisted or intermingled together to make a 2-ply yarn. In this example, a 150 denier standard polyester yarn was texturized and comingled with a 70 denier low melt yarn, and knit into the fabric ground.

Referring back to FIG. 6, loop pile yarn 26 should be selected based on the desired performance and cycle life. Pile yarn 26 may be a flat untexturized multifilament yarn, which typically will be napped prior to heatsetting to separate the filaments in the yarn bundle. Texturized yarns with a large number of filaments in the yarn bundle are relatively easy to texturize and bulk. Appropriate methods of texturizing include air jet and false twist, for example.

In other cases, cut staple spun yarns can be created using special polymers that can be extruded into fiber but are not strong enough to be used as a continuous filament yarn. In this case these weak fibers and blended together with stronger fibers, and made into cut staple "spun" yarns. In one prototype, extruded vinyl cut staple vinyl fiber is blended with standard Nylon, polyester, or other polymer, and made into yarn. Such yarns are available from RHOVYL in France (www.rhovyl.fr). Spinning blends of this type from cut staple fibers can be done by many suppliers. When this spun yarn is put into the ground of the fabric, and a conventional flat or texturized yarn is used in the pile, the cut staple fibers in the spun yarn will melt and fuse when heated to further bind the fabric, and may make the fabric more receptive to RF welding.

In a similar manner, filaments of a relatively high melt temperature polymer can be joined with filaments of a relatively low temperature polymer to form a single combined yarn having filaments of different melting temperatures. Such a combined yarn can be used as a ground yarn in the above knitting and setting process. Filaments of polymers of different temperatures can also be fed together into a common ground yarn feed hole of the circular knitting machine from different spools, such that they run in parallel in the knit structure, to produce a knit fabric that is then heat set according to the above method.

In the example fabric shown in FIGS. 2 and 5, bicomponent yarn 22 had a white sheath of low melt polyester encasing a high melt polyester core. We found that the fusing/setting process not only bound and stabilized the fabric ground, it also turned the white sheath of yarns 22 clear. As a result, the color of the back of the product became dominated by the color of the Nylon pile yarns, such as a yarn pre-dyed or dope-dyed black or red. In essence, the setting process turned the relatively white backside (technical face) of the product the color of the pile (e.g., black). For products requiring a black appearance, this process enabled the use of less expensive white bicomponent yarn, and also provided a visual indication that the stabilization was complete and consistent across the product.

Before setting, the fabric of FIG. 5 had an air permeability, as measured according to ASTM D737, of 297 CFM. After setting, the air permeability of the fabric of FIG. 2 had increased to 375 CFM, under the same test conditions. Such an increase in permeability (we have noted increases of 18% to 38%, for example) may be due in part to the change in effective diameter of at least some of the bicomponent ground yarns through the setting process. After setting, the cooled fabric had an in-plane Gurley stiffness, in each of two orthogonal directions, of 5.4 mm (face up) and 7.3 mm (face down), as measured according to ASTM D1388, Cantilever Method at 350 degrees F.

Figure 8:
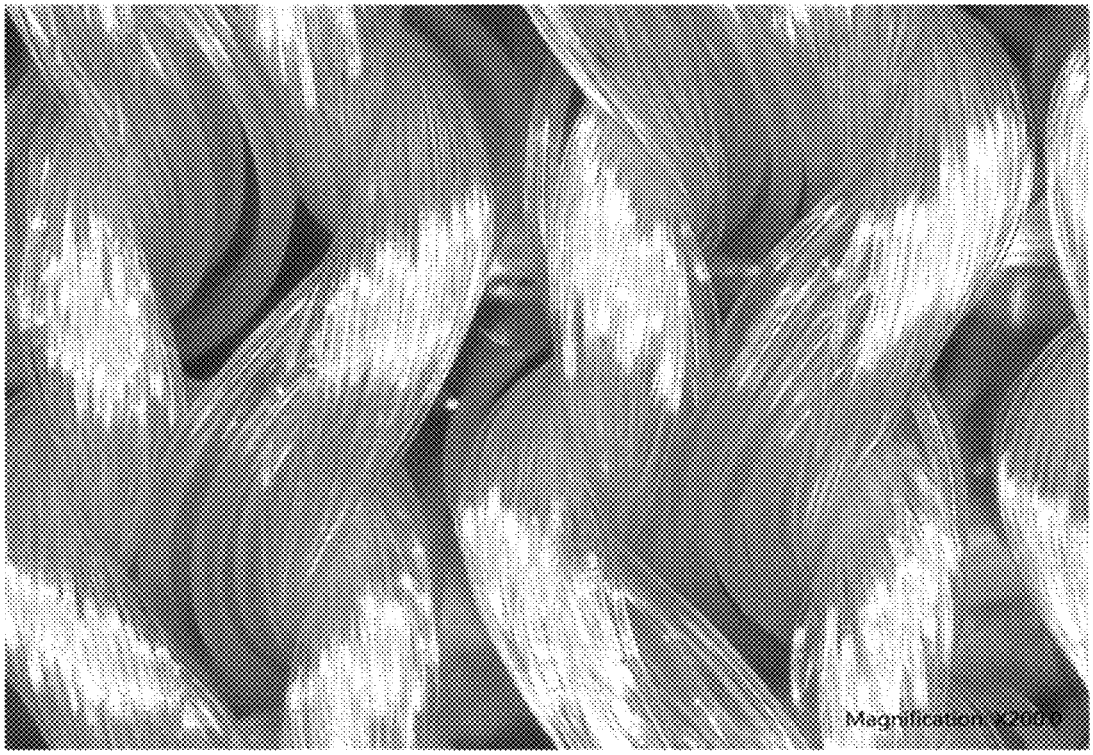
FIG. 8 is a magnified photograph of a back face of a second example of the product, before heat setting.
Figure 9:
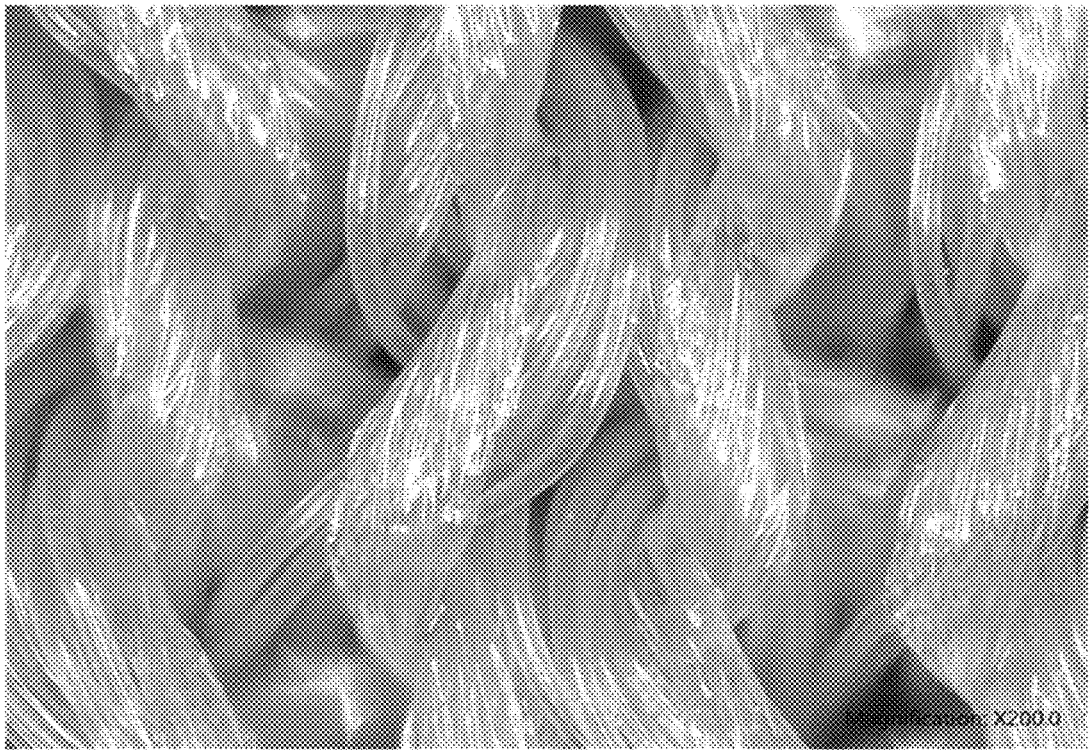
FIG. 9 is a magnified photograph of the back face of the product of FIG. 8, after heat setting.

Referring next to FIGS. 8 and 9, another example of a fastener loop product was prepared according to the above description, but using an undyed Nylon loop pile. Following knitting, the product was dyed with a dye that colored the Nylon pile filaments but did not affect the polyester ground fibers. The back side of the fabric remained essentially white until setting, and thereafter appeared essentially as the color of the dyed pile filaments. This example may have particular application in military clothing, given the need for very specific dye patterns and the desirability of high air permeability. The resulting product was dimensionally stable while retaining a high permeability, believed to be due in part to the reduction in diameter of the bicomponent filaments.

A third example of a fastener loop product (not shown) was prepared according to the above description, but using a 200/10 yarn (20 denier/filament) for the pile, using a 1.5 mm sinker. This example exhibited a higher cycle life as a fastener loop than was expected for such a lightweight fabric. Even lower profile loops are envisioned, formed over 1.0 mm sinkers. Such low profile loops are particularly advantageous for military uniforms, to help avoid sand fouling hook and loop closures.

Figure 10:
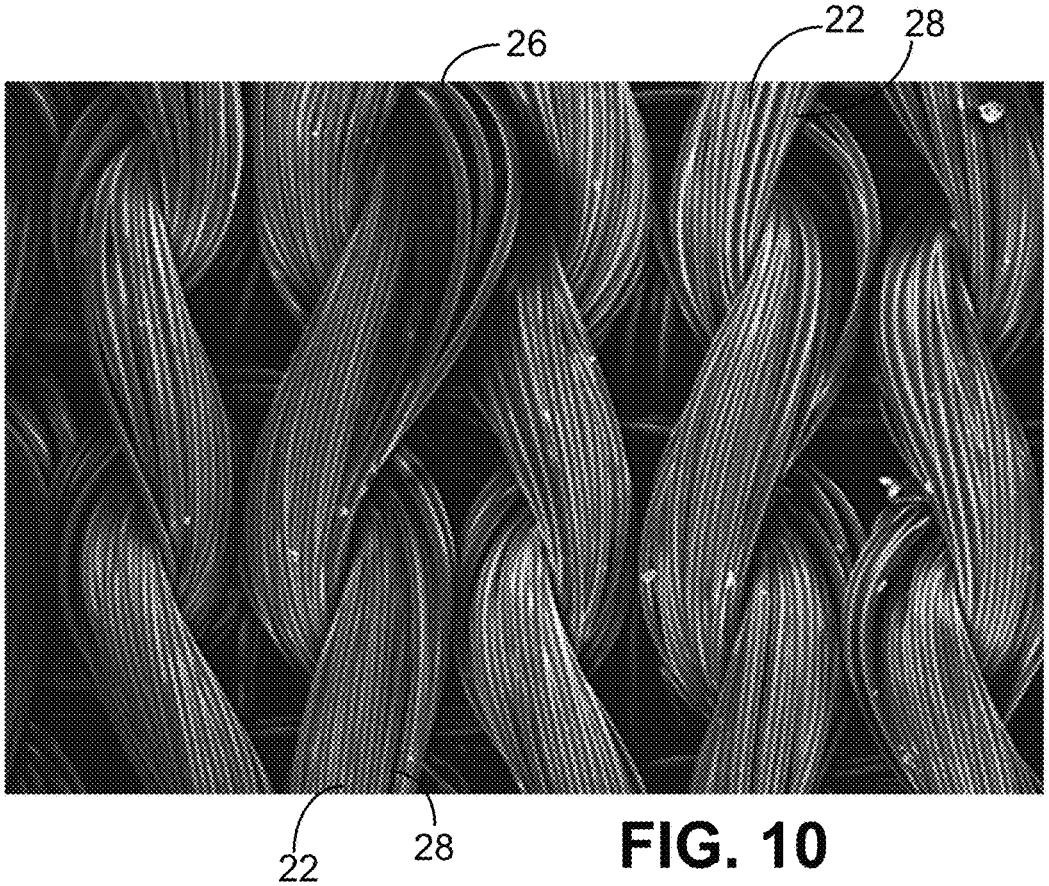
FIG. 10 is a magnified photograph of a back face of a third example of the product, before heat setting.
Figure 11:
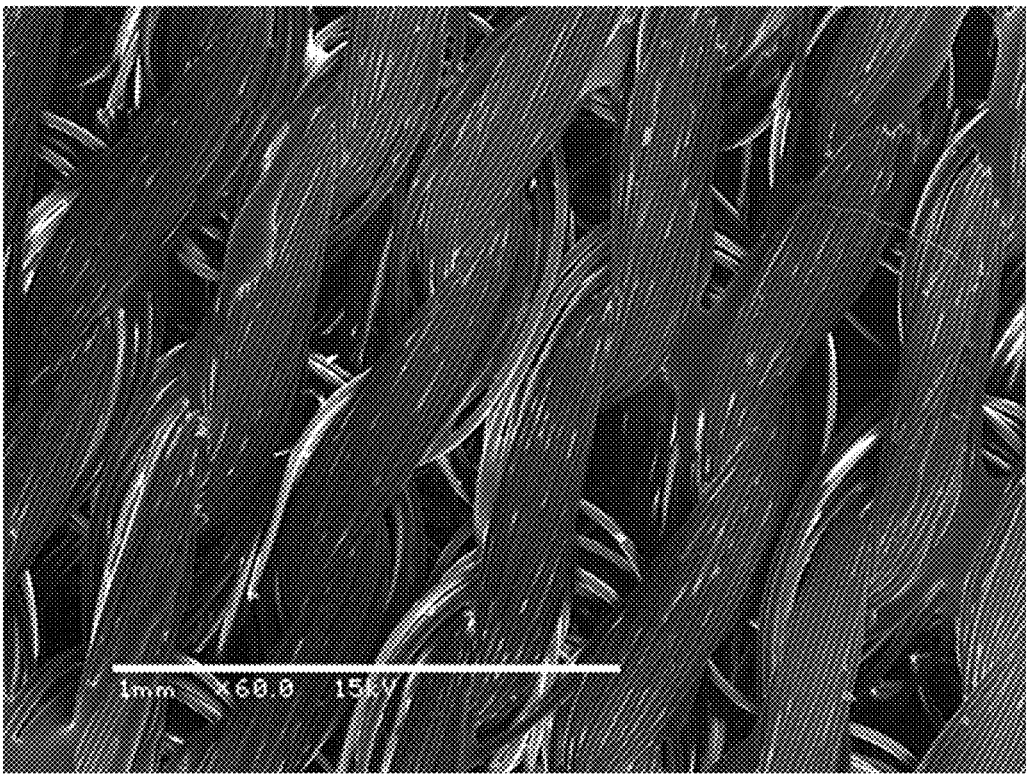
FIG. 11 is a magnified photograph of the back face of the product of FIG. 10, after heat setting.
Figure 12:
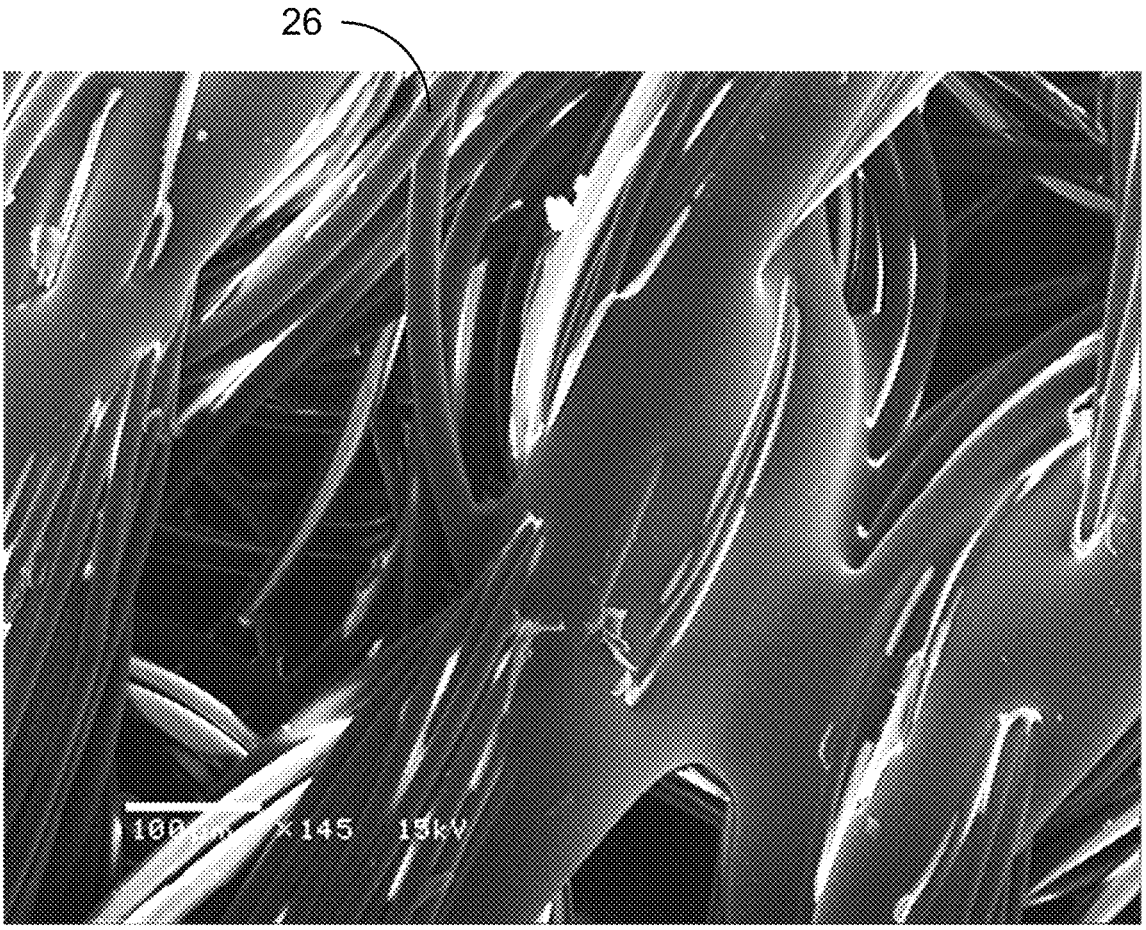
FIG. 12 is an even more magnified photograph of the product as shown in FIG. 11.

Referring next to FIGS. 10-12, a fourth example of a fastener loop product was prepared according to the above description, but with a low melt Nylon yarn run parallel to the bicomponent ground yarn in the knitting process. The subsequent heat setting process fully melted the low melt Nylon yarn and then also melted the bicomponent ground yarn sheath. The resulting fabric had a back surface that was RF-weldable, with the low melt Nylon acting as a hot melt adhesive for binding the product to another material by radio frequency welding. In another example (not shown), a urethane yarn (such as Spandex or Lycra) is run together with the bicomponent ground yarn, and knit with a high melt temperature Nylon pile yarn, to form a product that is RF-weldable due to the presence of the urethane, even though not stretchable due to the non-stretchable bicomponent ground yarns. Even the first example described above has proven to be RF-weldable under some conditions, by heating the Nylon pile yarn fabric with appropriate RF energy and pressure to melt the polyester outer sheath of the bicomponent ground yarns. Forming the product to have a technical face that is primarily polyester instead of Nylon can help to prevent moisture regain that can adversely affect weld strength.

A PVC-coated polyester yarn may also be a useful ground yarn for an RF-weldable product. RF-weldability has particular utility in medical applications.

An alternate process of heat setting any of the above fabrics involves a thermoforming process in which the knit fabric is placed in a mold to hold it in a non-planar form, and then heat set to mold the fabric into that form.

While a number of examples have been described for illustration purposes, the foregoing description is not intended to limit the scope of the invention, which is defined by the scope of the appended claims. There are and will be other examples and modifications within the scope of the following claims.

What is claimed is:

1. A method of making a loop fastener product, the method comprising knitting a pile yarn and one or more ground yarns to form a stretchable knit fabric having loops of the pile yarn extending from a knit ground, wherein at least one of the ground yarns comprises a bicomponent yarn with a filament comprising a first portion of a first polymer and a second portion of a second polymer, the first and second portions bonded together along a length of the filament and defining a boundary between the first and second polymers;

holding the knit fabric in a flat state; and while the fabric is held, setting the fabric by first applying sufficient heat to cause resin of the first portion of the bicomponent yarn filament to flow into interstices of the fabric ground, and then allowing the fabric to cool, such that the cooled fabric has a greater air permeability after setting than before setting, and has hook-engageable pile loops extending from interstices bound by the first polymer.

2. The method of claim 1, wherein knitting the pile yarn and one or more ground yarns comprises circular knitting.

3. The method of claim 1, wherein the first portion of the filament of the bicomponent yarn forms a sheath about a filament core of the second polymer.

4. The method of claim 1, wherein the bicomponent yarn is a first yarn of the one or more ground yarns, the one or more ground yarns also comprising a second yarn of a third polymer.

5. The method of claim 4, wherein the third polymer is of a lower melting point than the second polymer.

6. The method of claim 4, wherein the knitting comprises feeding the first and second yarns together through a common hole to a needle rack of a circular knitting machine.

7. The method of claim 4, further comprising texturizing the first and second yarns together prior to knitting.

8. The method of claim 1, wherein the pile yarn comprises an extruded monofilament having a tenacity of at least 4 grams per denier.

9. The method of claim 1, wherein applying sufficient heat comprises applying heat only in selected areas of the fabric, thereby causing a variation in setting across the fabric.

10. The method of claim 1, wherein the pile yarn is of a different color than the bicomponent yarn, and wherein setting the fabric changes a perceptible color of a side of the fabric opposite the pile loops.

11. The method of claim 1, wherein the pile yarn is a multi-filament yarn.

12. The method of claim 1, wherein the pile yarn comprises texturized yarn.

13. The method of claim 9, wherein the heat is applied by controlled jets of hot air.

14. The method of claim 9, wherein the heat is applied by an embossed heater roll having a patterned surface over which the fabric is trained.

15. The method of claim 9, wherein the variation in setting causes the fabric to pucker out of its plane.

16. The method of claim 1, wherein the cooled fabric ground is less stretchable in two orthogonal directions after setting than before setting.

17. The method of claim 1, wherein holding the knit fabric comprises increasing a width of the fabric as the resin of the sheath flows, thereby maintaining the knit fabric in a taut state during heating.

* * * * *